US005287653A

United States Patent [19]

Young

[11] Patent Number: 5,287,653

[45] Date of Patent: Feb. 22, 1994

[54] STORAGE CABINET WITH SLIDING DOORS

[76] Inventor: Nelson Young, 112 Cuba Hill Rd., Greenlawn, N.Y. 11740

[21] Appl. No.: 917,836

[22] Filed: Jul. 21, 1992

[51] Int. Cl.[5] ..... E05D 15/20

[52] U.S. Cl. ..... 49/130; 49/209; 312/295

[58] Field of Search ..... 49/127, 128, 130, 209, 49/211, 212; 312/139, 139.2, 295, 296

[56] References Cited

U.S. PATENT DOCUMENTS

| | | | |
|---|---|---|---|
| 1,687,870 | 10/1928 | Matson | 49/130 |
| 1,996,310 | 4/1935 | Skoogh | 49/130 |
| 2,672,656 | 3/1954 | Lorenz | 49/209 |
| 3,683,552 | 8/1972 | Bollinger | 49/209 |
| 3,841,024 | 10/1974 | Cheng | 49/130 |
| 4,114,317 | 9/1978 | Crawley | 49/209 |
| 4,644,690 | 2/1987 | Caimi | 49/130 |
| 4,669,219 | 6/1987 | Tomida | 49/130 |
| 4,708,410 | 11/1987 | Mazaki | 49/130 X |
| 4,930,256 | 6/1990 | Kawanishi et al. | 49/209 |
| 4,949,504 | 8/1990 | Bortoluzzi | 49/130 |

FOREIGN PATENT DOCUMENTS

| | | | |
|---|---|---|---|
| 1317697 | 1/1963 | France | 312/295 |

*Primary Examiner*—Peter M. Cuomo
*Assistant Examiner*—Jerry Redman
*Attorney, Agent, or Firm*—Kane, Dalsimer, Sullivan, Kurucz, Levy, Eisele and Richard

[57] ABSTRACT

A cabinet with sliding doors includes tracks for supporting said doors and track shifting members for shifting the doors between two positions. In one position the doors are disposed adjacent a cabinet frame defining an opening, said doors sealing said opening. In another position of the tracks the doors are spaced away from the frame and each other so that they can slide at will to allow objects to be inserted or withdrawn from the cabinet. A handle may be used to shift the tracks back and forth. The doors may be transparent to permit the cabinet to be used for displaying as well as storing articles.

18 Claims, 7 Drawing Sheets

STORAGE CABINET WITH SLIDING DOORS

BACKGROUND OF THE INVENTION

A. Field of Invention

This invention pertains to a novel sliding door arrangement and more particularly to an arrangement particularly useful for a storage cabinet arranged and positioned to selectively close and seal the cabinet.

B. Description of the Prior Art

Cabinets with sliding doors are often used for storing various objects because they are easy to operate and require less space than cabinets with swinging doors. If the doors are made of glass other transparent materials, then the cabinet can also be used as a display means. Typically, these prior art cabinets includes several sets of coextensive tracks, one set for each, door, with the doors being engaged and guided by the tracks. One major problem with these type of doors is that in order to allow them to move along parallel planes, the doors were offset transversely from each other leaving an air gap therebetween. As a result, the cabinets could not be sealed properly and hence could not be used for storing and/or displaying objects which require a closed environment.

OBJECTIVES AND SUMMARY OF THE INVENTION

In view of the above mentioned disadvantages of the prior art, it is an objective of the present invention to provide a sliding door arrangement which can act efficiently as an environmental seal.

A further objective is to provide a cabinet with a sliding door arrangement which may be sealed at will.

A further objective is to provide a cabinet with sliding doors which is easy and relative inexpensive to manufacture.

Other objectives and advantages of the invention shall become apparent from the following description of the invention.

Briefly, a door assembly for a cabinet and the like constructed in accordance with the present invention includes frame means, first and second tracks and mounting means for mounting said first and second tracks on said frame means. The mounting means is arranged and constructed to allow movement of said tracks in a direction perpendicular to said tracks.

A first door is slidably mounted on said first track while a second door slidably mounted on said second track. A shifting means is also provided for shifting said tracks between a first position wherein said doors are sealed against said frame means and a second position wherein said doors are offset thereby permitting said doors to slide independently in their respective tracks.

DETAILED DESCRIPTION OF THE INVENTION

Figure 2:
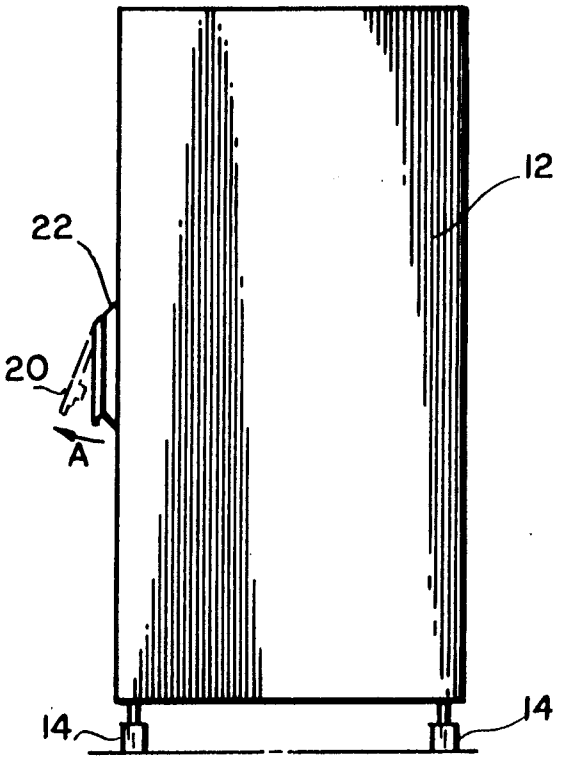
FIG. 2 shows a right side elevational view of the cabinet of FIG. 1.
Figure 1:
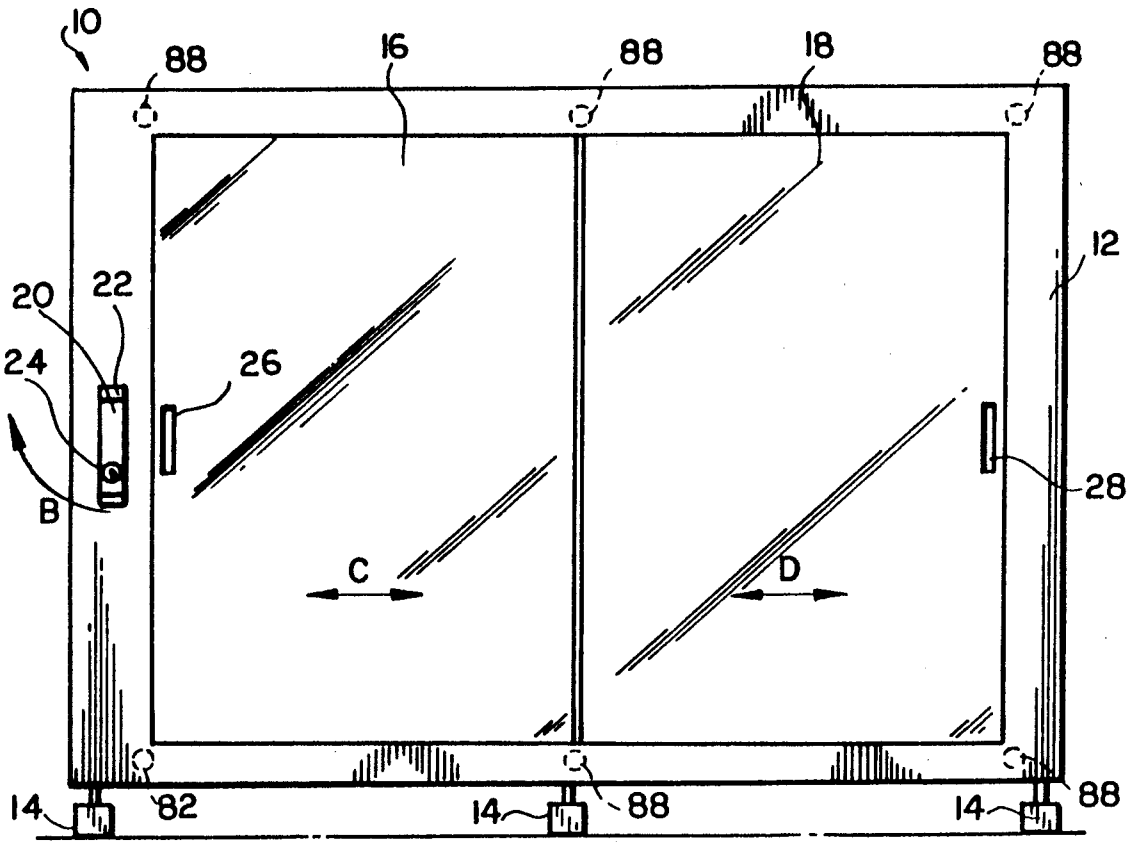
FIG. 1 shows a front elevational view of a cabinet constructed in accordance with this invention.

Referring now the drawings, and more particularly to FIGS. 1-3, a cabinet 10 constructed in accordance with this invention includes a enclosure 12 resting on several supports 14. On the front, the enclosure 12 has a door opening defining a door frame and covered by two sliding doors 16, 18. Preferably these doors are made of tampered glass to permit the cabinet to be used for a display for its contents. For this purpose, cabinet 10 may be provided on the inside with various shelves, drawers, support rods, etc. for holding items to be stored and displayed therein. These support means have been omitted herein for the sake of clarity.

On one side, cabinet 10 is provided with an elongated handle 20 pivotably attached to enclosure 12 at one end 22. At the opposite end, handle 20 is provided with a lock 24. Lock 24 is used to selectively secure handle 20 to the enclosure 12 in the closed position shown in FIG. 1. When the handle is in this locked position, the two doors 16, 18 abut each other and are disposed in a single vertical plane thereby sealing the cabinet off. For this purpose several sealing strips are provided between the doors and the door frame as described more fully below. In this locked position since the doors 16, 18 are in an abutting relationship, they cannot slide with respect to each other or with respect to the enclosure 12.

In order to gain access to the cabinet the handle lock 24 is opened, and handle 20 is pivoted upwardly as shown in FIG. 2 by arrow A. Next, the handle 20 is rotated clockwise as shown in FIG. 1 by arrow B for example by about 90°. This latter movement causes the doors 16, 18 to shift away transversely from their sealing or locked position to a sliding position. That is, each door 16, 18 is shifted by handle 20 into a sliding position wherein the two doors are spaced away from the floor frame and disposed in two corresponding parallel planes. Preferably door 16 is disposed in front of door 18.

Door 16 is equipped with a door handle 26 and in the sliding position it can be shifted with this handle 26 to the right towards an open position or the left towards a closed position as indicated by arrow C. Similarly, door 18 can be moved in sliding motion between a closed and an open position along direction indicated by arrow D, using handle 28. In the sliding position, because of the vertical spacing between the two doors, the cabinet 10 is not environmentally sealed. When the two doors are in the closed position, handle 20 can be returned to the locked position shown in FIG. 1 thereby shifting the doors back to their sealed positions.

The apparatus for the transversal shifting of the doors is described below in conjunction with FIGS. 4-8.

Figure 4:
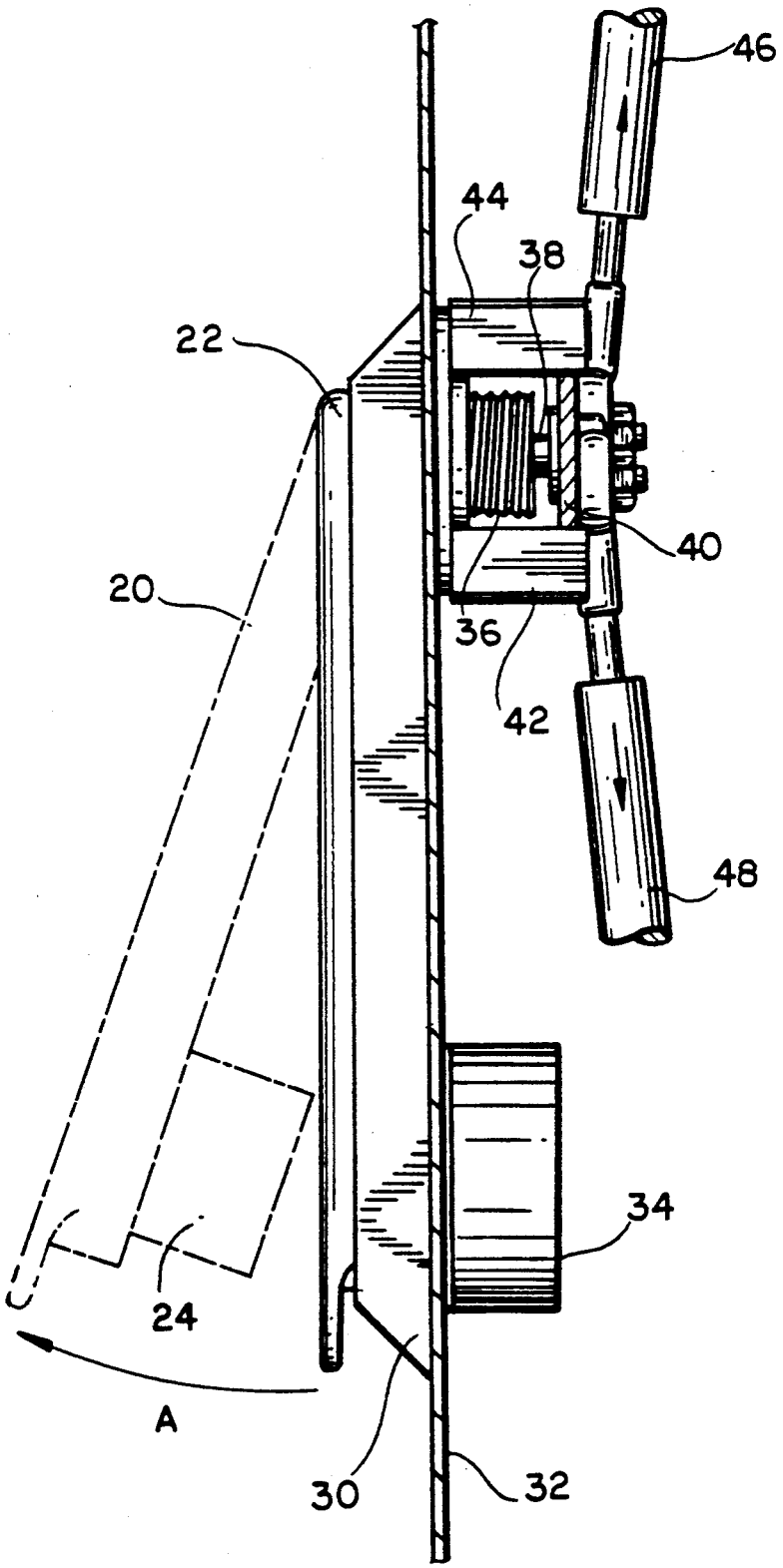
FIG. 4 shows a side elevational view of the cabinet handle mechanism of FIG. 1.
Figure 5:
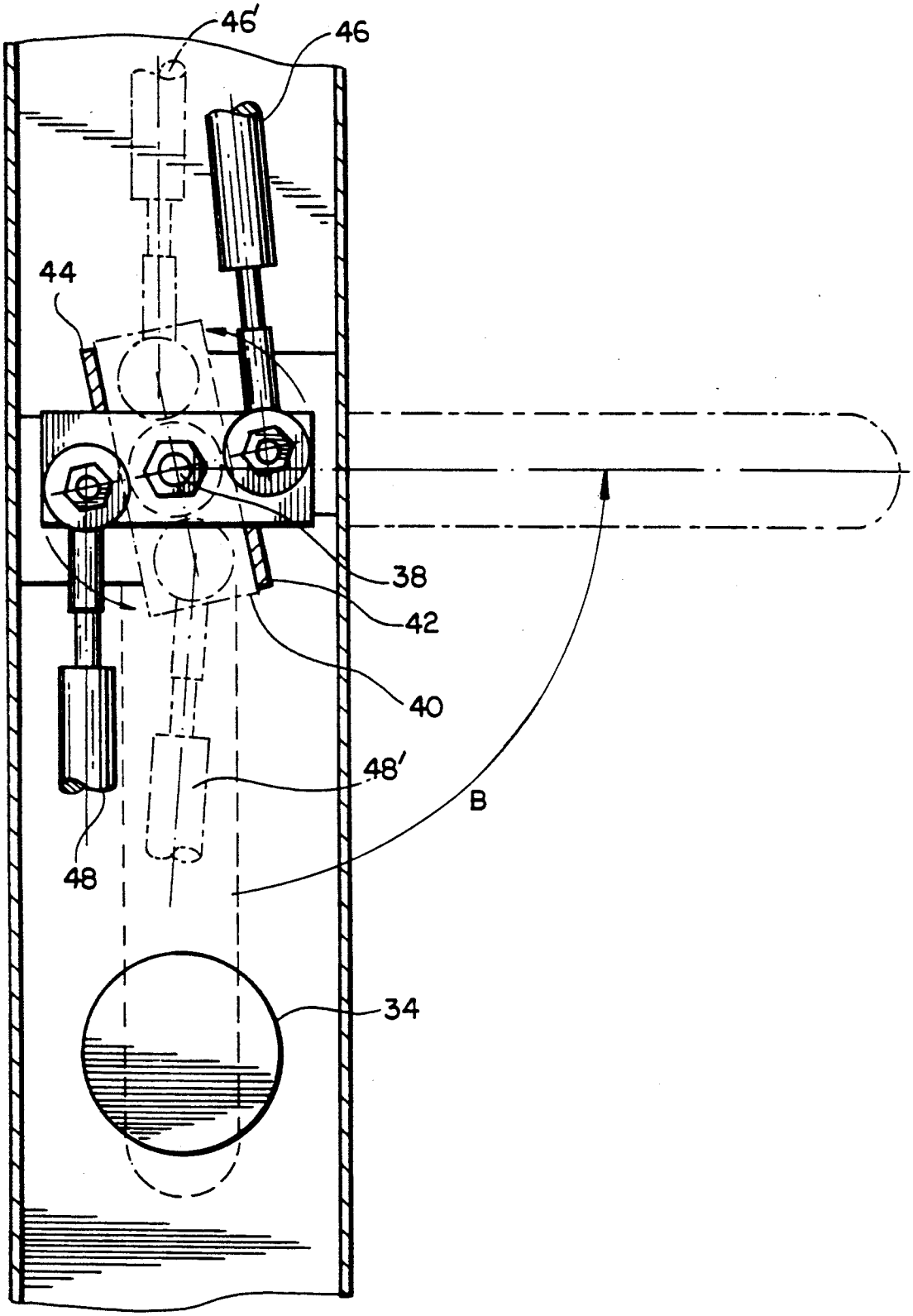
FIG. 5 shows a rear elevational view of the handle mechanism of FIG. 4.

As shown in FIG. 4, handle 20 is mounted on the enclosure 12 by a handle housing 30. Handle housing 30 is secured to a front panel 32 of enclosure 12. Handle 20 is pivotally and rotatably supported to housing 30 by a bushing 36. Housing 30 is also provided with a lock cap 34 defining a cavity mating with lock 24. In the locked position, handle 20 is disposed essentially vertically with lock 24 disposed in and engaging lock cap 24. When a the lock 24 is disengaged from the lock cap 34 with a key (not shown), handle 20 is free to pivot upwardly as shown. Once the lock 24 clears the handle housing 30, the handle is clear to rotate in the direction B shown in FIGS. 2 and 5.

Near end 22, handle 20 has a handle shaft 38 extending through bushing 36. Mounted on shaft 38 is a plate 40 such that the plate rotates about the axis of the shaft when the handle is rotated in the direction B. Two fixed stops 42, 44 are used to limit the rotation of plate 40 and therefore handle 20.

Two rods 46, 48 are pivotally attached to plate 40 in such a manor that rod 46 moves upward to the position shown in dotted lines (46') when the handle is rotated clockwise. Simultaneously rod 48 moves downward to the position 48'. Rod 48 extends downwardly to a track shifting assembly, described below. Rod 46 extends upwardly to another similar track shifting assembly. As shown in FIG. 7, the distal end of rod 48 is pivotally connected to an arm 54 secured to a shaft 56. Shaft 56 extends substantially through the length of enclosure 12 and is rotatably mounted to the bottom thereof by a bushing 60. The rod 48, arm 56 and shaft 58 are constructed and arranged to cause the shaft to rotate counterclockwise in the direction F when the rod moves to position 48'. Rod 46 is similarly arranged to rotate a shaft 62 (FIG. 6) rotatably mounted by bearing 64 below the ceiling (not shown) of enclosure 12.

Figure 8:
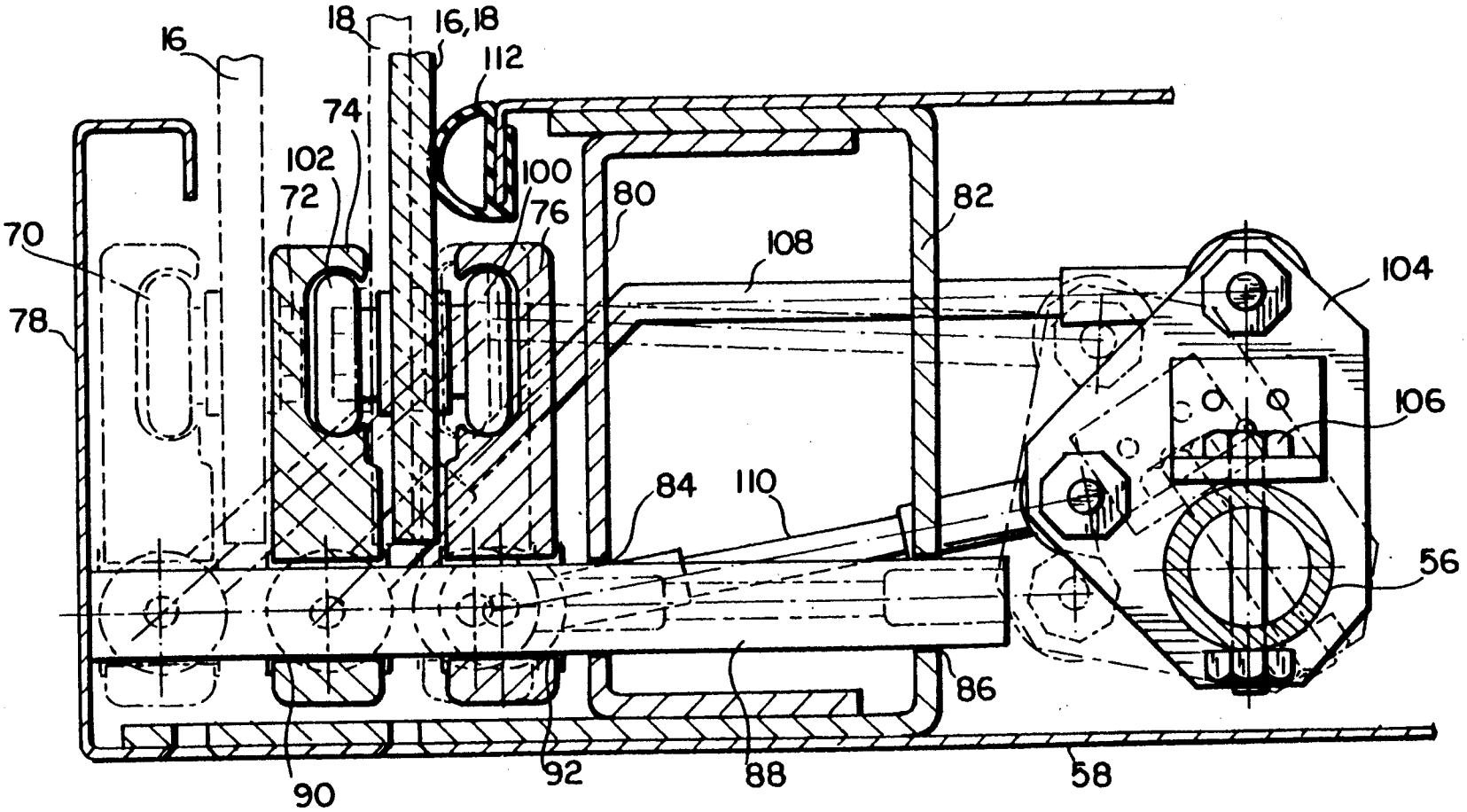
FIG. 8 shows a partial sectional view of the cabinet of FIG. 1 showing enlarged details of the coupling between the track cam and the tracks.

FIG. 8 shows details of the tracks for the doors 16, 18 as well as the remaining elements of the track shifting assembly 50. In this Figure the doors 16, 18 are shown in their sliding position. Door 16 is provided at its lower edge with two identical wheels 70 (only one wheel 70 being shown for the sake of clarity). Wheel 70 is journalled on an axle 72 mounted on door 16 as shown. Enclosure 12 is also provided with two lower tracks 74, 76, one for each of the doors 16, 18. The bottom 58 extends into a vertical wall portion 78 which is shaped to wrapped over track 74 for protection. Also on bottom 58, there is a frame 83 formed of two channels 80, 82. The tracks 74, 76 and the frame 83 formed of channels 80, 82 extend along the length of enclosure 12. The channels 80, 82 have circular openings such as at 84, 86 for holding a cylindrical pin 88. The pin extends from openings 84, 86 towards wall 78 and is supported in a cantilevered manner by the channels 80, 82, as shown. Preferably three pins 88 are provided at the top of the enclosure above the doors and three pins are provided at the bottom, as shown in FIG. 1. Tracks 74, 76 are provided with openings 90, 92 respectively for mounting the tracks on the pins 88, either directly or by using sleeves 94. Preferably the openings 90, 92 accepting the central pins 88 are just slightly larger than but the same shape as the pins 88. The openings 90, 92 for the end pins 88 may be slightly elongated horizontally to provide tolerance and allow for the thermal expansion of the tracks.

In this manner, tracks 74, 76 are mounted inside enclosure 12 so that they are slidable in a direction perpendicular to the doors 16, 18. Track 76 has a C-shaped opening 100 facing track 74. Track 74 has a similar C-shaped opening 102 facing track 76. These openings 100, 102 house the wheels 70, 72 thereby supporting the doors 16, 18 respectively.

As shown in FIG. 8, a roughly triangular plate 104 is affixed on shaft 56 by a nut-and-bolt arrangement 106. Thus, plate 104 rotates with shaft 56. A plate 104 is disposed at each end of tracks 74, 76. Attached to plate 104 are two rods 108, 110.

Figure 3A:
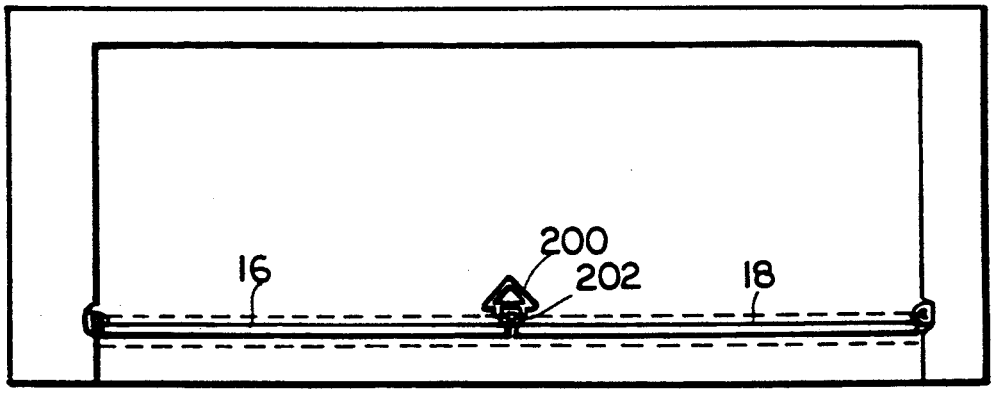
FIGS. 3A, 3B and 3C show a top view of the cabinet of FIG. 1.
Figure 3B:
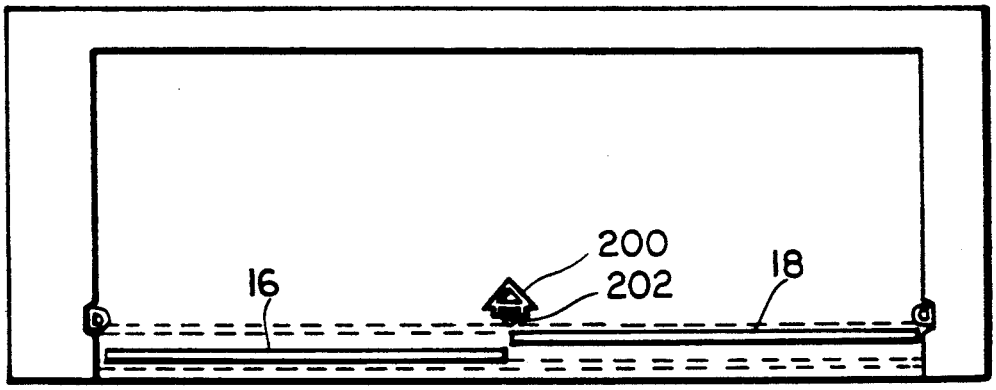
Figure 3C:
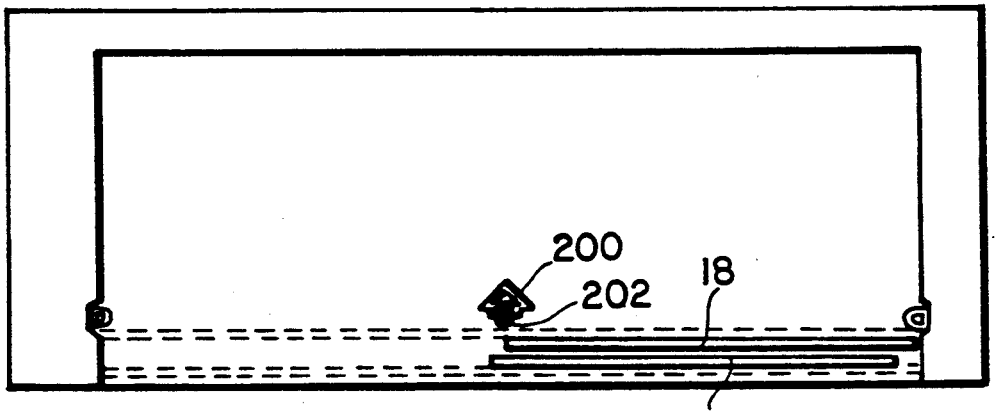
Figure 6:
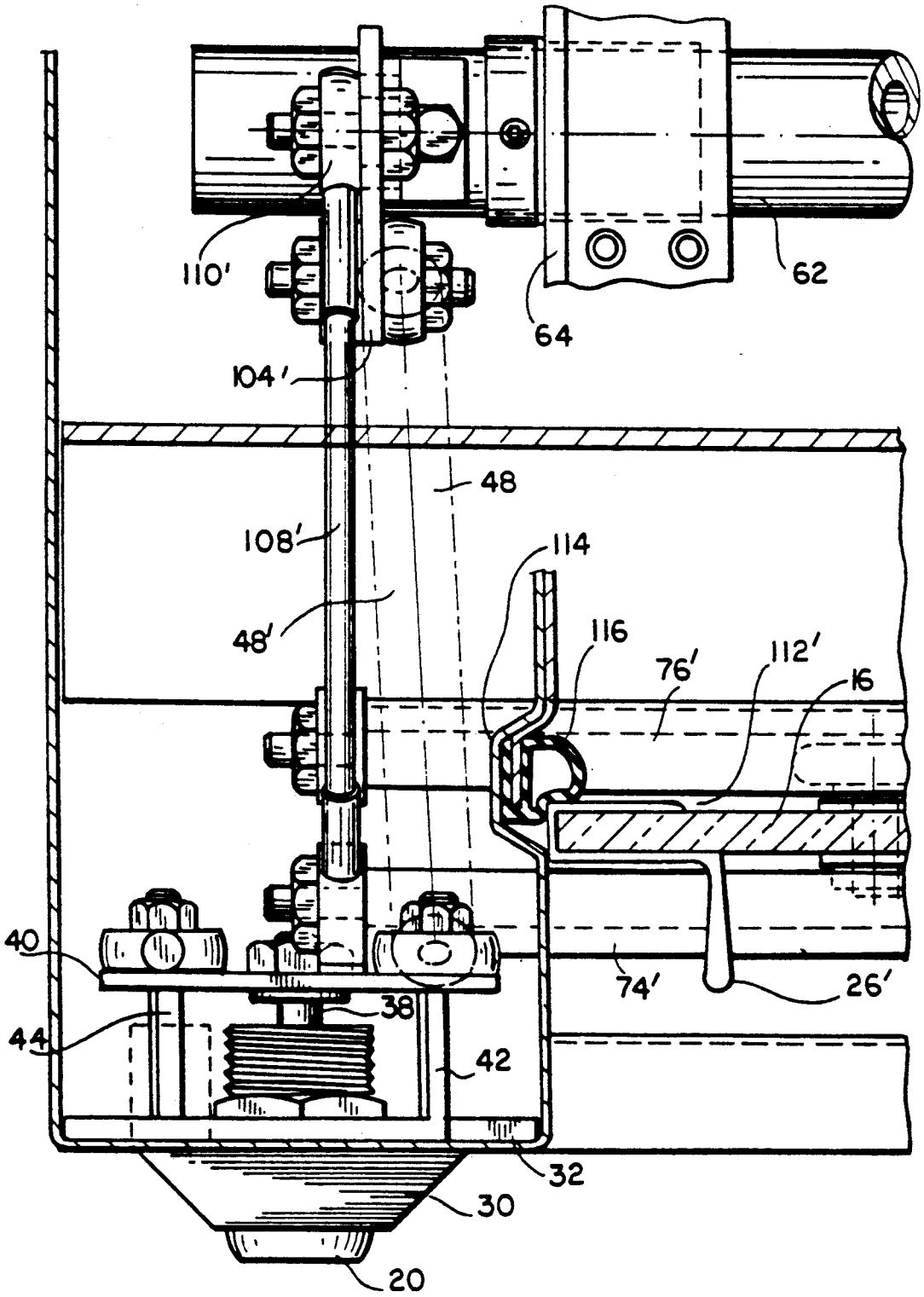
FIG. 6 shows a partial plan view of the cabinet of FIG. 1 showing details of the coupling between the handle mechanism and the track cam.
Figure 7:
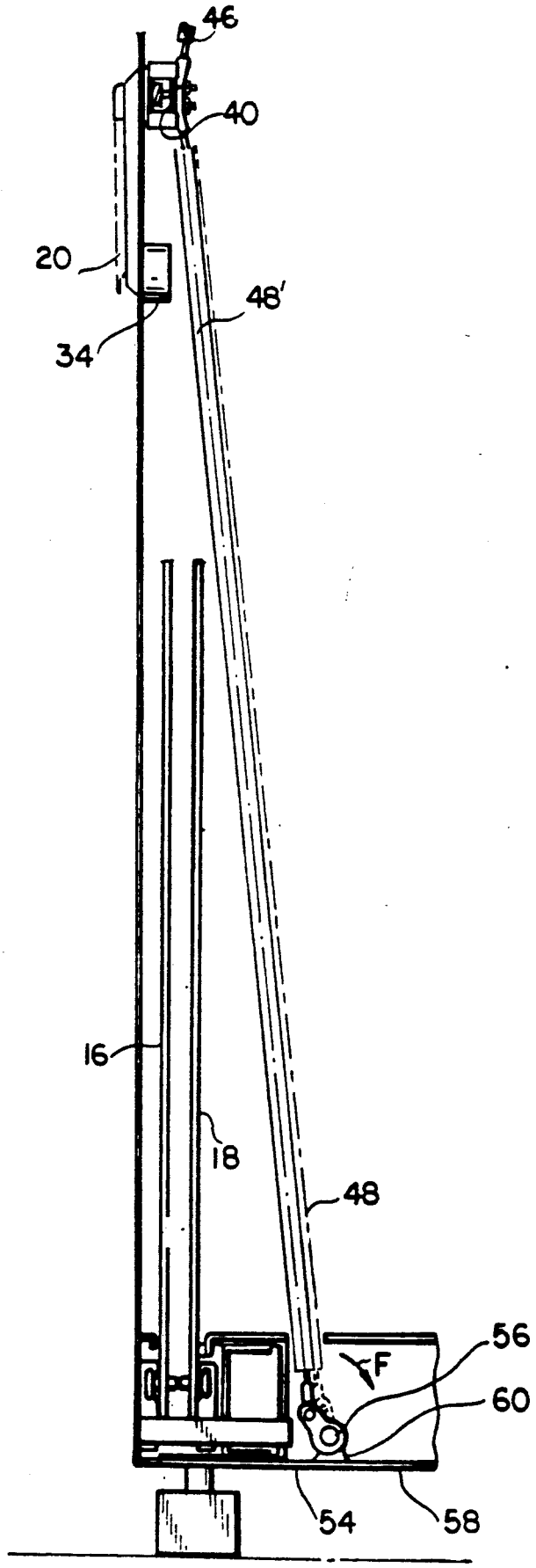
FIG. 7 shows a partial sectional view of the cabinet of FIG. 1 showing details of the coupling between the handle mechanism and the track cam.

For a better understanding of the operation of the shifting assembly, reference is now made to FIG. 6 wherein the details of the upper right shifting assembly are shown. In this Figure a plate 104' identical to the plate 104 in FIG. 8 is shown mounted on shaft 62, and having rod 108' extending to the end of track 78'. The rod 108' and plate 104' are constructed and arranged so that as the shaft 62 turns, the track is shifted transversely to the door 18. The four rods 108 are actuated simultaneously by the shafts 56, 62 so the door 18 and its tracks 74, 74' are all shifted smoothly and evenly. Similarly rods, 110, 110' are actuated by plates 104, 104' to shift tracks 76, 76' and door 16 in response to the rotation of shafts 56, 62. More specifically, when the handle 20 is in the locked position, tracks 74, 74' and 76, 76' are positioned to maintain doors 16, 18 in a single plane. As shown more clearly in FIG. 8 a D-shaped horizontal rubber seal 112 is mounted on the bottom frame member 83. A similar seal is mounted on a top frame member (not shown). In FIG. 8, door 18 is shown pressed against the seal 112 so that the seal is slightly deformed. In addition, as shown in FIG. 6, the enclosure 12 is provided with a wall portion defining a vertical frame member having a groove 114 for housing a vertical rubber seal 116. A similar vertical seal is provided on the other side of the enclosure 12. The seal is angled so that in the locked position of the handle 20, the door 16 is pressed against seal 116 as shown in FIG. 6. Similarly, door 18 is pressed against the vertical seal on the other side of the enclosure. In this manner the horizontal and vertical frame members described above cooperate to form a door frame for enclosure 12 and the horizontal and vertical seals provide a sealing means for sealing the doors in the locked position against the door frame. In this manner, in the locked position of the handle, the doors 16, 18 form with seals 112, 112', 116, a substantially air-tight enclosure 12. For relatively large enclosures, a central vertical beam 200 may be provided with its own vertical seal 202, as shown in FIGS. 3A–C with each of the doors being biased against of these vertical seals, thereby eliminating any air gap between the doors.

When the handle 20 is unlocked and rotated in direction B as shown in FIG. 1, both doors are shifted away from the door frame. Importantly, door 18 and its tracks 76, 76' move forward by a relatively small amount, for example by about 0.125" while the door 16 and tracks 74, 74' move forward by a much larger amount, for example about 1.00". In these sliding positions, the doors 16, 18 are freely slidable on their tracks to remove from or place objects into the enclosure as required.

The sliding door assembly described herein is not limited to storage cabinets but may be used for other purposes as well.

Obviously numerous modifications may be made to this invention without departing form its scope as defined in the appended claims.

I claim:

1. A sliding door arrangement comprising:

frame means;

first and second tracks;

mounting means for mounting said first and second tracks on said frame means, said mounting means being arranged and constructed to allow movement of said tracks in a direction perpendicular to said tracks;

a first door slidably mounted on said first track;

a second door slidably mounted on said second track; and a handle mounted on said frame and movable between a first handle position and a second handle position;

shifting means coupled to said handle for shifting in response to movement of said handle between said handle positions at least one of said tracks between a first track position wherein said doors are sealed against said frame means and a second track position wherein said doors are offset thereby permitting said at least of said doors to slide in a respective track.

2. The sliding door arrangement of claim 1 wherein said doors are substantially co-planar in said first track position.

3. The sliding door arrangement of claim 1 wherein said first and second tracks are straight.

4. The sliding door arrangement of claim 1 wherein said first and second tracks extend in parallel.

5. A storage cabinet comprising:

an enclosure with frame means defining an enclosure opening;

a movable handle mounted on said enclosure;

first track means disposed adjacent to said frame means;

a first door slidably mounted on said first track means and covering said enclosure opening; and track shifting means coupled to said handle for shifting said first track means in response to movement by said handle between a first position in which said first door is positioned against said frame means to seal said opening and a second position in which said first door is displaced from said frame.

6. The storage cabinet of claim 5 wherein said track means includes an upper track disposed at the top of said enclosure opening and a lower track disposed at the bottom of said disclosure opening.

7. The storage cabinet of claim 5 further comprising:

second track means disposed adjacent to said enclosure opening;

a second door slidably mounted on said second track means and covering said enclosure opening;

said track shifting means further shifting said second track means between a first position in which said second door is positioned against said frame means to seal said opening and a second position in which said second door is displaced from said frame.

8. The storage cabinet of claim 7 wherein said first and second doors are substantially coplanar in said first position.

9. The storage cabinet of claim 7 wherein said first and second doors are offset from each other in a direction transversal to said track means in said second position.

10. The storage cabinet of claim 7 wherein said first and second track means are shifted simultaneously by said track shifting means.

11. The storage cabinet of claim 5 wherein said handle is arranged and constructed for manually shifting said first track means.

12. A storage cabinet comprising:

an enclosure with frame means defining a rectangular enclosure opening having a top and a bottom;

track means including a first lower track disposed adjacent to said bottom and a first upper track disposed adjacent to said top;

a handle movably mounted on said enclosure;

a first door slidably mounted between said first tracks and covering said enclosure; and track shifting means coupled to said handle for shifting said tracks responsive to movement of said handle in a direction perpendicular to said first door between a first position wherein said door is disposed against said frame for sealing said opening, and a second position wherein said door is away from said frame.

13. The cabinet of claim 12 wherein said track means includes a second lower track adjacent to said bottom and a second upper track adjacent to said top; wherein said cabinet further comprises a second door slidably mounted between said second tracks for covering said enclosure opening, and wherein said track shifting means shifts said second track between a first position in which said second door is disposed against said frame and a second position wherein said second door is spaced away from said frame.

14. The cabinet of claim 13 wherein said doors are coplanar in said first position.

15. The cabinet of claim 13 wherein in said first position said doors cooperate to seal said enclosure opening.

16. The cabinet of claim 13 wherein said handle is movable between a first handle position and a second handle position, and a plurality of disks, each disk being coupled to said handle for transmitting the movement of said handle to said tracks.

17. The cabinet of claim 16 wherein said frame includes a plurality of support pins normal to said tracks, and said tracks are slidably mounted on said pins.

18. The cabinet of claim 13 wherein said door is made of a transparent material.

* * * * *